United States Patent [19]

Pringle

[11] Patent Number: 4,460,046

[45] Date of Patent: Jul. 17, 1984

[54] CONTROL FLUID COMMUNICATION NIPPLE

[75] Inventor: Ronald E. Pringle, Houston, Tex.

[73] Assignee: Camco, Incorporated, Houston, Tex.

[21] Appl. No.: 440,667

[22] Filed: Nov. 10, 1982

[51] Int. Cl.[3] ..... E21B 34/14

[52] U.S. Cl. ..... 166/317; 166/318; 166/334; 137/68 R

[58] Field of Search ..... 166/317, 318, 376, 332, 166/334, 154; 137/68 R

[56] References Cited

U.S. PATENT DOCUMENTS

| | | | |
|---|---|---|---|
| 2,976,932 | 6/1961 | Baker | 166/334 |
| 3,661,207 | 5/1972 | Current et al. | 166/317 |
| 3,901,333 | 8/1975 | Mori | 175/318 |
| 4,031,957 | 6/1977 | Sanford | 166/317 |

*Primary Examiner*—Ernest R. Purser

*Assistant Examiner*—Mark J. Del Signore

*Attorney, Agent, or Firm*—Fulbright & Jaworski

[57] ABSTRACT

A communication nipple for communicating control fluid flow from the outside of a well tool to the inside of a well tool through a fluid passage in the well tool without the use of elastomer seals. A metal breakable screw extends vertically into and initially blocks the passageway with a metal-to-metal seal and extends to the inside of the well tool. The screw includes a cavity exposed to the passageway. A vertically-moving breaking sleeve is connected to the screw and is adapted to break the screw in tension and expose the cavity to the interior of the well tool when the sleeve is moved away from the screw. The present apparatus is particularly useful for supplying hydraulic control fluid into the valve bore of a first well safety valve for controlling a second safety valve positioned in the first valve bore.

14 Claims, 8 Drawing Figures

Fig. 6
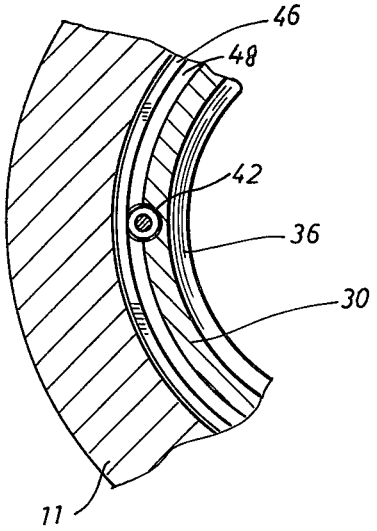
Fig. 7
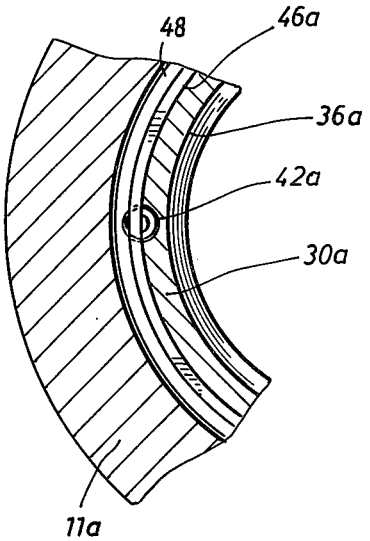
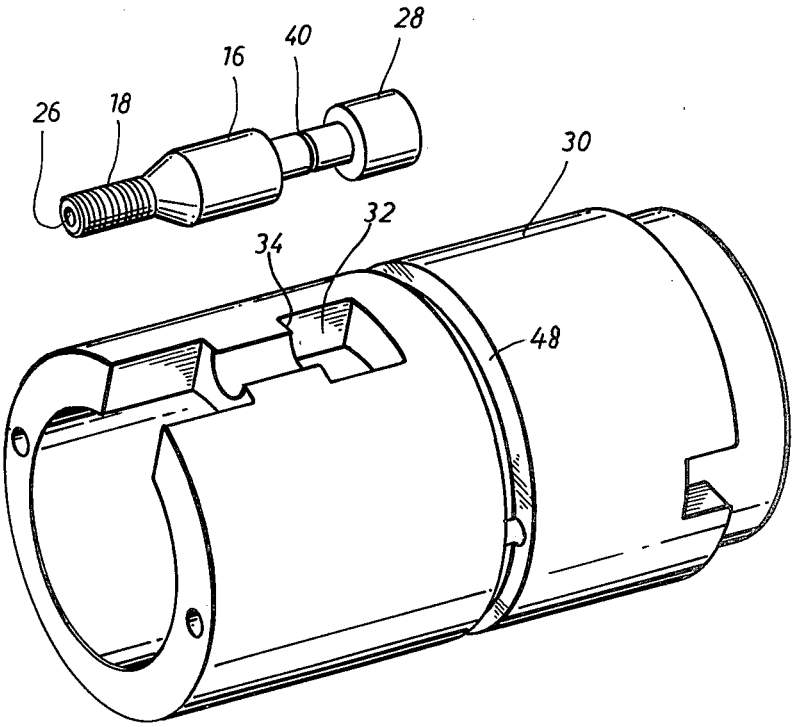
Fig. 8

CONTROL FLUID COMMUNICATION NIPPLE

BACKGROUND OF THE INVENTION

It is known to utilize a sliding sleeve to shear a plug which is normally closed to open fluid communication between the exterior and the interior of a well tool for controlling a second well tool as shown in U.S. Pat. Nos. 3,786,866 and 3,799,258. However, some of the prior art devices use elastomer seals which have a short life in many hostile well bore environments, were transversely sheared creating the possibility of blocking the fluid communication, and were positioned to undesirably increase the wall thickness.

The present invention is directed to a fluid communication nipple for initially blocking the communication of fluid from the outside of a well tool to the inside of a well tool but being openable when desired without the use of elastomer seals, is broken in tension to provide fluid flow, and is positioned so as not to interfere with wall thickness.

SUMMARY

The present invention is directed to a communication nipple for communicating flow from the outside of a well tool to the inside of a well tool through a fluid passage in the well tool without the use of elastomer seals. A frangible metal member extends vertically into and blocks the passageway with a metal-to-metal seal and extends to the inside of the well tool. The member has a cavity exposed to the passageway. A vertically moving breaking sleeve is positioned adjacent the member and is adapted to break the member by a tension pull and expose the cavity to the interior of the well tool when the sleeve is moved relative to the member.

Still a further object is the provision of a vertically extending frangible holding means initially securing the breaking sleeve against movement. Preferably, the holding means holds the breaking sleeve out of vertical contact with the member.

A further object is the provision of means for holding the member, when broken, in a separated position to insure that the fluid communication through the member is not blocked.

Yet a still further object of the present invention is wherein the frangible member is a metal screw having threads for screwing into the passageway, includes a metal sealing surface for engaging a metal sealing surface around the passageway, and includes a head for engagement by the sleeve.

Still a further object of the present invention is the provision of a fluid controlled safety valve having a valve element and seat in a body for controlling the fluid flow through the well bore and tubing with means for biasing the valve in a direction to close and hydraulic control means adapted to extend to the well surface for supplying fluid acting on the valve in a direction to open the valve. An improved fluid control means supplies hydraulic control fluid into the valve bore for controlling a second safety valve positioned in the valve bore. A first valve body includes a fluid passageway extending into the bore and adapted to be connected to the surface for receiving hydraulic control fluid. A metal frangible screw vertically extends into the passageway and initially blocks the passageway with a metal-to-metal seal, and the screw extends into the bore and includes the cavity exposed to the passageway. A vertically moving breaking sleeve is engagable with the screw and adapted to break the screw in tension and expose the cavity to the bore when the sleeve is moved relative to the screw.

Other and further objects, feature and advantages will be apparent from the following description of a presently preferred embodiment of the invention, given for the purpose of disclosure and taken in conjunction with the accompanying drawings.

BRIEF DESCRIPTION OF THE DRAWINGS

FIG. 6 is a cross-sectional view taken along line 6—6 of FIG. 1, FIG. 7 is a cross-sectional view taken along line 7—7 of FIG. 2, and FIG. 8 is a perspective exploded view of the frangible member and breaking sleeve of the present invention.

DESCRIPTION OF THE PREFERRED EMBODIMENTS

For the purpose of illustration only, the present invention will be described in connection with its use in a first tubing safety valve for supplying control fluid to a second retrievable safety valve positioned in the interior of the first safety valve. However, it is to be recognized that the present invention may be useful in controlling and communicating fluid from the outside of various types of well tools to the inside of the well tools for various other functions.

Figure 1:
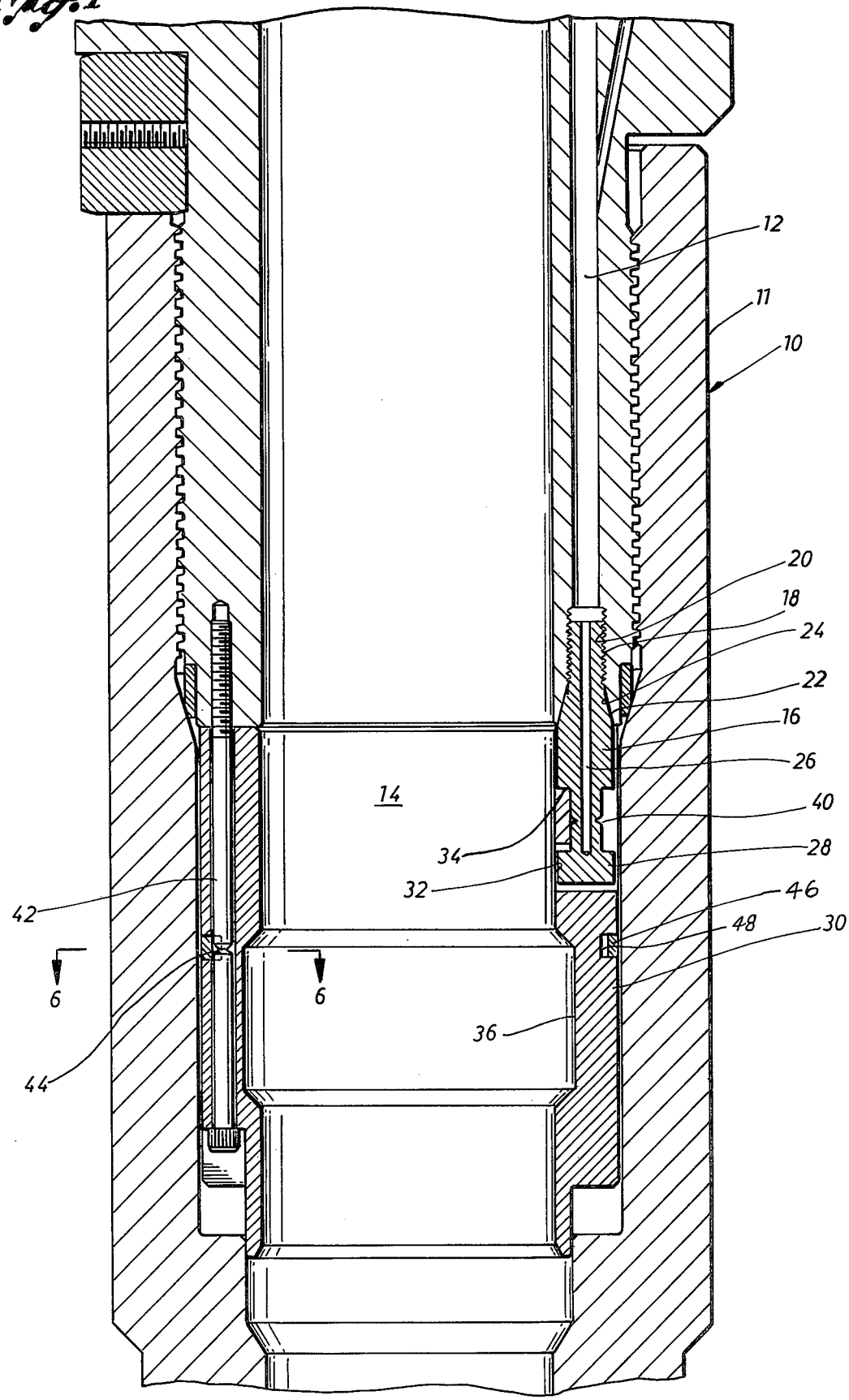
FIG. 1 is a fragmentary elevational view, in cross section, of the fluid communication nipple of the present invention shown in its initial position.

Referring now to the drawings, particularly FIG. 1, a fluid communication nipple is generally indicated by the reference numeral 10 having a body 11 and a fluid passageway 12 adapted to be connected to fluid means extending to the well surface for supplying fluid and extends normally to the open bore 14 of the body 11. Therefore, fluid may be supplied from the well surface through the passageway 12 for various reasons such as actuating a well tool positioned in the bore 14 when the passageway 12 is open. However, initially when there is no need for fluid communication to the bore 14 a metal frangible member, such as for example a plug or screw 16 (FIGS. 1 and 8) is provided extending vertically into and blocking the flow of control fluid through the passageway 12. The screw 16 includes threads 18 for coacting with threads 20 in the body 11 for securing the screw therein. Sealing of the passageway 12 by the screw 16 is accomplished by coacting metal surfaces 22 and 24 on the screw 16 and body 11, respectively. These metal sealing surfaces are preferably tapered and are advantageous over the usual elastomer seals as they can withstand the hostile environment of high temperatures and corrosive fluids which are present in many wells. The screw 16 includes a cavity 26 exposed to the passageway 12, and the screw 16 includes means such as a head 28 for gripping and fracturing the screw 16 for opening communication of the passageway 12 with the bore 14. Of course, other types of plugs may be used in place of the screw 16.

It is advantageous for the member 16 to be vertically positioned. That is, the thickness of the wall of the housing 11 must be sufficient to accommodate the member 16 and therefore the prior art horizontally disposed screws undesirably require greater than the usual wall thickness.

A vertically-moving breaking sleeve 30 is provided vertically movable in the bore 14 of the body 11 and includes a recess 32 for receiving the head 28 of the screw 16. On one side of the recess 32, the sleeve includes a shoulder 34 adapted to contact and engage the head 28 and pull the screw 16 in tension to break the screw 16 and expose the cavity 26 to the bore 14 when the sleeve 30 is moved downwardly away from the screw 16. The sleeve 30 includes any suitable means such as a tool recess 36 which a suitable well tool engages to move the sleeve 30 downwardly to break the screw 16. If desired, a notch 40 may be placed around the exterior of the screw 16 to aid in positioning or controlling the place of the break. It is a further advantage to break the member 16 by a tension pull as the cavity 26 does not get blocked. That is, transverse shearing of a screw may close the cavity passageway in the screw and block fluid passage.

However, the recess 36 is exposed to the bore 14 and is subject to various other types of downhole tools engaging the recess 36 which might accidentally break the screw 16 at an undesired time. Therefore, one or more frangible bolts 42 are provided for initially holding the breaking sleeve 30 against movement. The bolts 42 are secured to the body 11 and extend vertically to allow vertical movement of the sleeve 30 and initially hold the sleeve shoulder 34 out of vertical contact with the screw head 28 so that any accidental bumping of the recess 36 by other well tools will not tend to weaken or break the screw 16. However, when the sleeve 30 is actuated, the bolt 42 is broken, such as about an indentation 44, thereby releasing the sleeve 30 for contact with the head 28 of the screw 16 for breaking the screw 16 and opening the passageway 12 to the bore 14.

Figure 2:
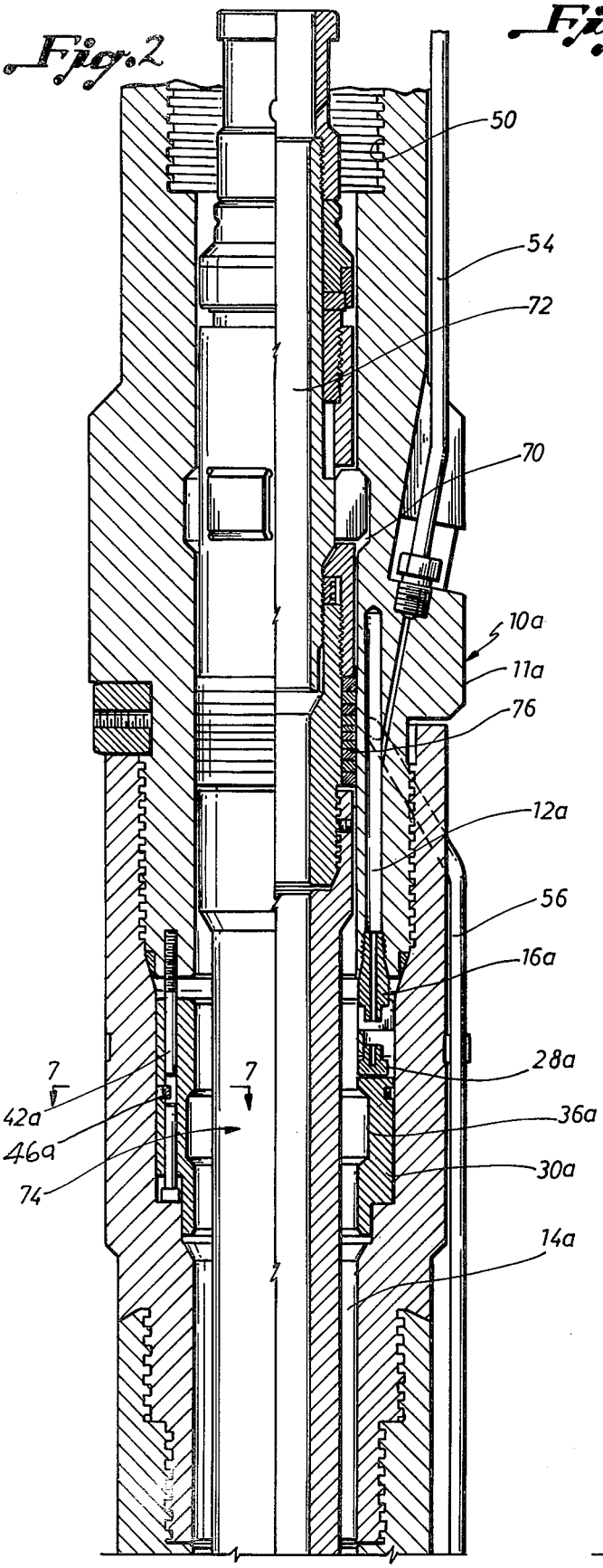
FIGS. 2, 3, 4 and 5 are elevational views, partly in cross section, and continuations of each other showing the communication nipple of the present invention used in a tubing retrievable safety valve and in the open position for providing control fluid to a second safety valve positioned in the bore of the first safety valve.
Figure 3:
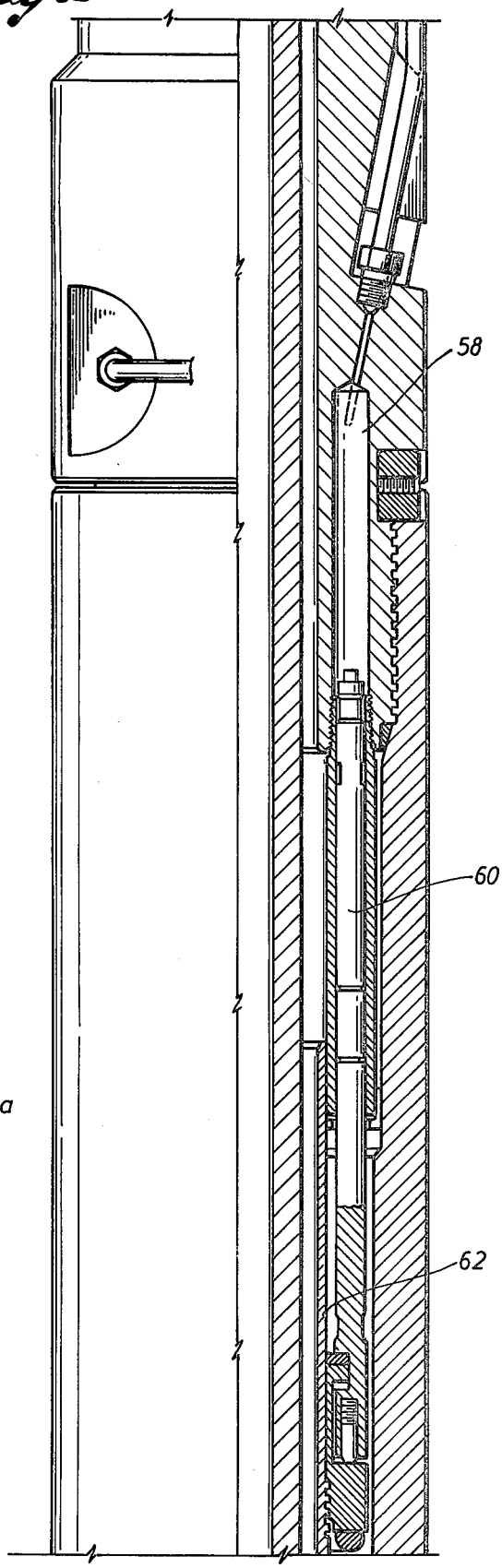
Figure 4:
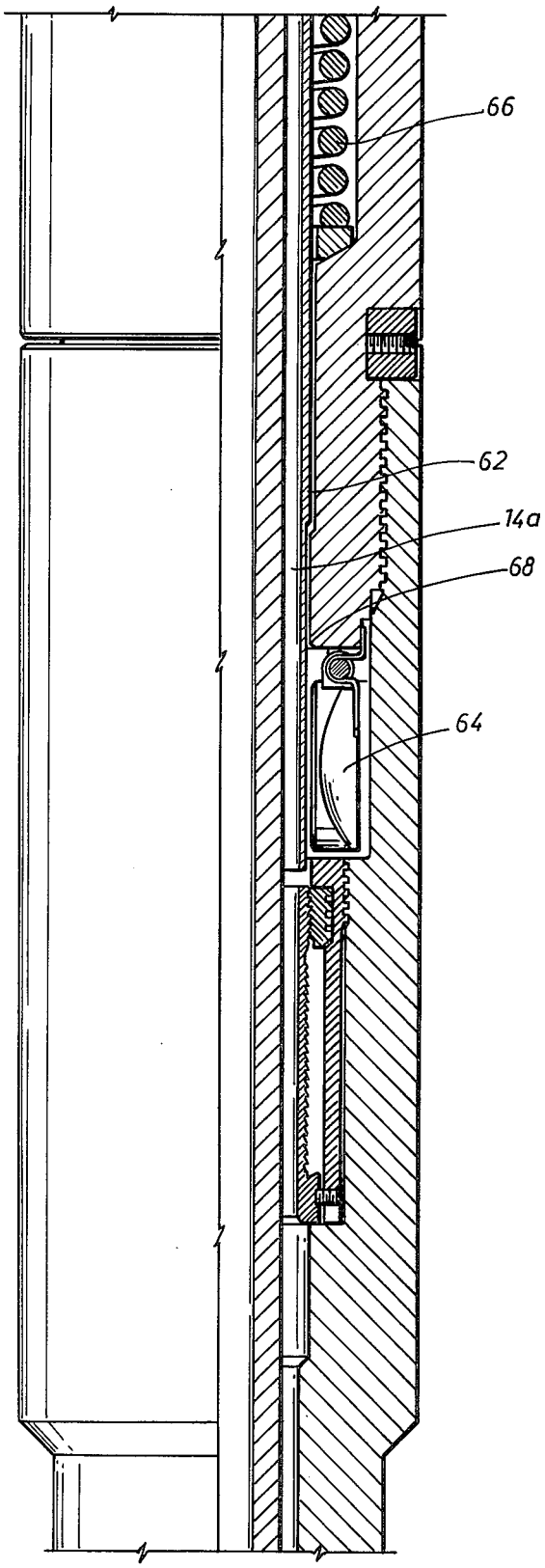
Figure 5:
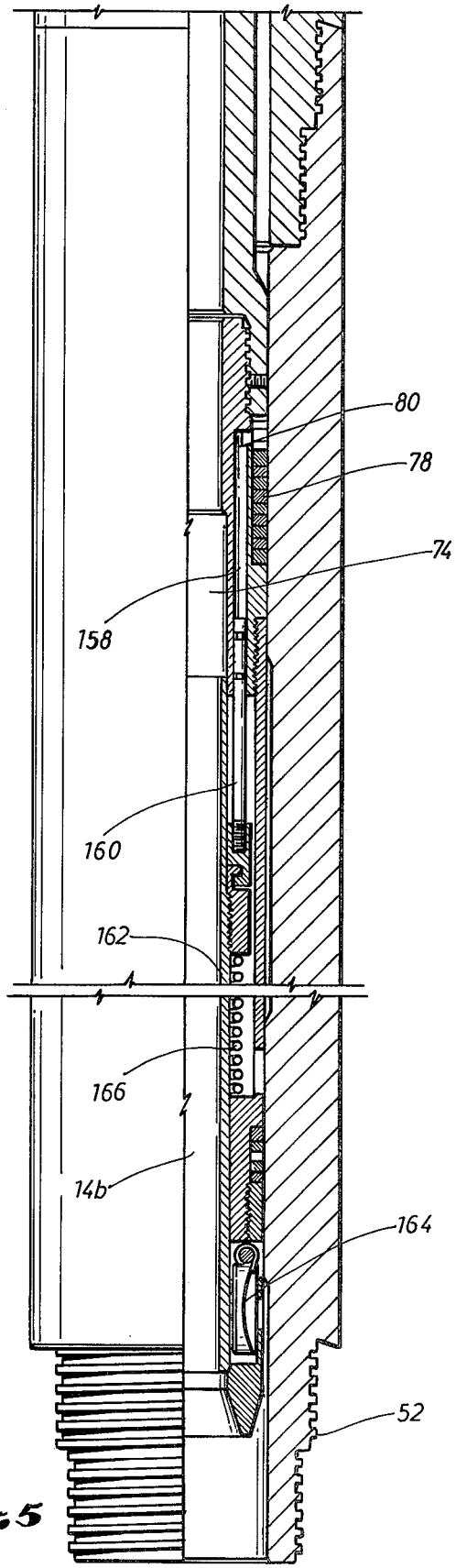

After the bolts 42 and plug 16 are broken, it is desirable that the broken parts of the plug 16 remain separated in order to insure that fluid flow through the cavity 26 is not blocked. A lock ring 46 (FIGS. 1 and 6) may be provided in a recess 48 in the sleeve 30 adjacent the indentation 44. The ring 46 may be an expanded C-ring, which, when the bolts 42 are broken, contracts into the space between the broken parts of bolts 42. The contraction of ring 46 keeps the sleeve 30 and thus the head 28 in a downward position thereby keeping the broken parts of the plug 16 separated. See FIGS. 2 and 7 for the expanded ring **46*a* holding the broken parts of bolts 42*a*** apart.

FIGS. 2–5 show the use of the communication nipple of the present invention in a primary tubing safety valve in an open position for supplying control fluid to a secondary safety valve positioned in the bore of the primary tubing safety valve. The parts in FIG. 2 identical with those in FIG. 1 are similarly numbered with the suffix "a". The primary or tubing safety valve **10*a* includes threads 50 and 52 at either end for connection in a conventional well tubing. A hydraulic control line 54 extends to the well surface and is in fluid communication with the passageway 12*a*. While a separate control line could be run to actuate the primary safety valve 10*a*, it is preferable to utilize a tubing 56 connected to the passageway 12*a* and leading to a chamber 58 (FIG. 3) for actuating one or more pistons 60 which in turn actuate a flow tube 62 for controlling the opening and closing of a valve element 64. Biasing means such as a spring 66 and/or well pressure acting on the pistons 60 act in a direction to move the flow tube 62 upwardly. When the flow tube 62 is moved to the downward position by hydraulic fluid acting in the control line 56 and against the pistons 60, the flow tube 62 pushes the flapper valve element 64 away from the valve seat 68. Thus the valve 10*a* is held in the open position so long as the flow tube 62 is in the downward position. When the flow tube 62 is moved upwardly by the reduction of hydraulic fluid in the lines 54 and 56 and in chamber 58, the spring 66 and well fluid acting on the piston 60 move the flow tube 62 upwardly and the valve element 64 is allowed to seat on the valve seat 68 and close flow through the bore 14*a*. A fuller description of the construction and operation of the safety valve 10*a*** can be found in U.S. patent application Ser. No. 383,897, filed June 1, 1982, which is incorporated herein by reference.

However, as pointed out in U.S. Pat. No. 3,799,258, the primary or tubing safety valve may become inoperative and it is therefore desirable to position a second or retrievable type safety valve in the bore of the first safety valve for protecting the well. Therefore, in the event of a failure of the primary safety valve **10*a*, means are provided in the bore 14*a* of a recess 70 (FIG. 2) for supporting a conventional well lock 72 such as a Camco Type C lock which in turn supports a second safety valve generally indicated by the reference numeral 74. The second safety valve 74 is constructed and arranged so as to be controlled by the fluid in the passageway 12*a*. The safety valve 74 includes a packoff 76 against the interior of the first safety valve 10*a* above the frangible plug 16*a* and a second packoff 78 (FIG. 5) below inlet ports 80 in the second safety valve 74**.

Prior to setting the second safety valve 74 in the primary safety valve **10*a*, the control fluid in the passageway 12*a* which is initially closed by the screw 16*a* is opened to provide control fluid into the interior bore 14*a* of the primary safety valve 10*a* between the packoffs 76 and 78 of the secondary safety valve 74. Thus as previously described, a suitable tool is engaged in the recess 36*a* of the sleeve 30*a* and moved downwardly to pull the screw 16*a* apart by tension allowing the control fluid to pass into the bore 14*a* and into the ports 80 of the secondary safety valve 74**.

The secondary safety valve 74 may be similar to the primary safety valve **10*a* in structure and operation. Thus, the ports 80 of the secondary safety valve 74 lead to one or more fluid chambers 158 for applying a control fluid to one or more pistons 160 which are connected to a flow tube 162 which when it is moved downward opens a valve element 164. Biasing means such as spring 166 and/or the fluid in the bore 14*b* act to move the flow tube 162 upwardly when the control fluid is released from the ports 80 and the control line 54. Therefore, the second safety valve 74 may be inserted in the bore 14*a* of the nonretrievable safety valve 10*a* and assume the function of protecting the well, deactuating the first safety valve 10*a* and being controlled by the control fluid in the control line 54. However, the fluid communication nipple of the present invention allows the primary safety valve 10*a* to remain in the well under adverse conditions for extended periods of time before it is needed and thereafter perform the function of providing a control fluid to operate a second safety valve 74**.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. A communication nipple for communicating fluid flow from the outside of a well tool to the inside of the well tool through a fluid passageway in the well tool without the use of elastomer seals said fluid passageway extending to the inside of the well tool comprising, a metal frangible member positioned entirely inside of the well tool and extending vertically into and blocking the passageway, said metal member forming a metal seal at one end with the passageway and including a head, said member having a cavity exposed to the passageway, and a vertically moving breaking sleeve positioned between said one end and the head of said member and adapted to break said member in tension and expose the cavity to the interior of the well tool when the sleeve is moved relative to the member.

2. The apparatus of claim 1 including:

second vertically extending frangible holding means securing the breaking sleeve against movement.

3. The apparatus of claim 2 wherein the holding means initially holds the breaking sleeve out of vertical contact with the member.

4. The apparatus of claim 2 including locking means for holding the broken parts of said frangible member separated.

5. A communication nipple for communicating fluid flow from the outside of a well tool to the inside of the well tool through a fluid passageway in the well tool without the use of elastomer seals, said passageway extending to the inside of the well tool comprising, a metal frangible screw having a longitudinal axis extending vertically and having threads screwed into and blocking the passageway with a metal-to-metal seal, said screw having a cavity exposed to the passageway and including a head, and a vertically moving breaking sleeve positioned to engage the screw head and adapted to break said screw in tension and expose the cavity to the interior of the well tool when the sleeve is moved away from the screw.

6. The apparatus of claim 5 including, second vertically extending breakable holding means securing the breaking sleeve against movement.

7. The apparatus of claim 6 wherein the holding means initially holds the breaking sleeve out of vertical contact with the screw.

8. The apparatus of claim 6 including locking means for holding the broken parts of said screw separated.

9. The apparatus of claim 5 wherein the metal screw includes a tapered metal sealing surface for engaging a metal sealing surface around the passageway.

10. In a fluid controlled safety valve for use in a well tubing and having a valve element and seal in a body for controlling the fluid flow through the valve bore and tubing, means for biasing said valve in a direction to close, and hydraulic control means adapted to extend to the surface for supplying fluid acting on the valve in a direction to open said valve, the improvement in fluid control means for supplying hydraulic control fluid into the valve bore for controlling a second safety valve positioned in the valve bore comprising, a fluid passageway in the body extending into the bore and adapted to be connected to the surface for receiving hydraulic control fluid, a metal breakable screw having a longitudinal axis extending vertically into the passageway and having threads screwed into and initially blocking said passageway with a metal-to-metal seal, said screw having a cavity exposed to the passageway and said screw including a head, and a vertically moving breaking sleeve having a shoulder positioned between the threads and the head of the screw and adapted to break said screw in tension and expose the cavity to the bore when the sleeve is moved relative to the screw.

11. The apparatus of claim 10 including, second vertically extending breakable holding means securing the sleeve to the body.

12. The apparatus of claim 10 including, breakable means initially securing the sleeve to the body and initially holding the sleeve out of vertical contact with the screw.

13. The apparatus of claim 10 wherein the metal screw includes a tapered metal sealing surface for engaging a metal sealing surface around the passageway.

14. The apparatus of claim 12 including, locking means for holding the broken parts of the screw separated.

* * * * *